US008616964B2

(12) United States Patent
Patel

(10) Patent No.: US 8,616,964 B2
(45) Date of Patent: Dec. 31, 2013

(54) OPEN-ENDED BETTING POOL

(75) Inventor: Amish Patel, London (GB)

(73) Assignee: Cigno (B.V.I.) Ltd., Northwood (GB)

( * ) Notice: Subject to any disclaimer, the term of this patent is extended or adjusted under 35 U.S.C. 154(b) by 392 days.

(21) Appl. No.: 12/521,854

(22) PCT Filed: Mar. 6, 2008

(86) PCT No.: PCT/IB2008/001717

§ 371 (c)(1),
(2), (4) Date: Aug. 11, 2010

(87) PCT Pub. No.: WO2008/129425

PCT Pub. Date: Oct. 30, 2008

(65) Prior Publication Data

US 2010/0298045 A1 Nov. 25, 2010

(51) Int. Cl.
*A63F 9/24* (2006.01)

(52) U.S. Cl.
USPC ..... 463/26; 463/27; 463/28

(58) Field of Classification Search
USPC ..... 463/26, 27, 28
See application file for complete search history.

(56) References Cited

U.S. PATENT DOCUMENTS

| | | | | |
|---|---|---|---|---|
| 2003/0018564 | A1 | 1/2003 | Bonnier et al. | |
| 2004/0192437 | A1 * | 9/2004 | Amaitis et al. | 463/26 |
| 2007/0060308 | A1 | 3/2007 | Benrus | |
| 2007/0239592 | A1 * | 10/2007 | Brown et al. | 705/37 |

FOREIGN PATENT DOCUMENTS

| | | | |
|---|---|---|---|
| WO | WO 03/009239 | A2 | 1/2003 |
| WO | WO 03/046852 | A2 | 6/2003 |
| WO | WO 2007/024605 | A2 | 3/2007 |

OTHER PUBLICATIONS

International Search Report (PCT/ISA/210) for PCT/IB2008/001717, completed Nov. 7, 2008.

* cited by examiner

*Primary Examiner* — Pierre E Elisca
(74) *Attorney, Agent, or Firm* — Buchanan Ingersoll & Rooney PC

(57) ABSTRACT

Methods and systems for hosting a betting pool are disclosed. The betting pool can be hosted by a lead participant. Pool participants can be maintained through a partner relationship module. The betting pool lead participant manages events associated with the betting pool through an event manager and through a pool manager. Winning participants in the betting pool are determined and payouts can be processed.

18 Claims, 3 Drawing Sheets

OPEN-ENDED BETTING POOL

BACKGROUND

1. Field

The present embodiments relate generally to systems and methods for providing individuals to host electronic open-ended betting pools for the benefit of individuals even beyond their known circles of acquaintances anywhere in the world where gambling is legal, and more specifically to systems, methods and services for making closed-ended betting pools open-ended.

2. Background

All betting pools hosted by individuals at workplaces or in communities are closed-ended i.e. limited to people within the workplace or the community of which they are part of. Such betting pools are also non-auditable and limit financial gains up to a total amount wagered by members of the betting pool which is closed-ended (individuals known to each other within the workplace or community). Individuals and communities usually form a betting pools predicting the outcome of local, regional, national or international sporting, social, political and other kinds of events.

Existing betting companies including internet based betting companies do not provide systems, methods or service for individuals or communities to host their own open-ended betting pools nor closed-ended betting pools. Such companies do have the two extremes of making or losing money depending on the outcome of the event on which the bets were placed. In most cases such companies could end up not sharing any proceeds from the betting event with even a minority of the individuals who placed bets on the event.

Present systems, methods and services do not provide any form of tiered payments to individuals whose bets were placed on the outcome within certain threshold of the results of the event. Present systems, methods and services also do not allow the host of closed-ended betting pools to increase the placement of bets from outside the community or workplace to maximize the money in the pool.

SUMMARY

Embodiments disclosed herein address the above stated needs by considering the opportunity for individuals and communities participating in betting pools. Accordingly, embodiments of the invention include methods and systems for enabling open-ended betting pools. The service based on methods and systems described below will allow individuals and communities to establish and manage open-ended betting pools across geographic boundaries, jurisdictions and time zones, regardless of base currency of the country in which the individual is placing a bet from, which can be audited as well. Participation in the betting pool will be restricted to individuals hereinafter referred as "bidders" from countries in which gambling is legal and conform to local gambling laws.

BRIEF DESCRIPTION OF THE DRAWINGS

The accompanying drawings, which are incorporated in and constitute part of the specification, illustrate various embodiments of the invention. Together with the general description, the drawings serve to explain the principles of the invention. In the drawings.

DETAILED DESCRIPTION

Figure 1:
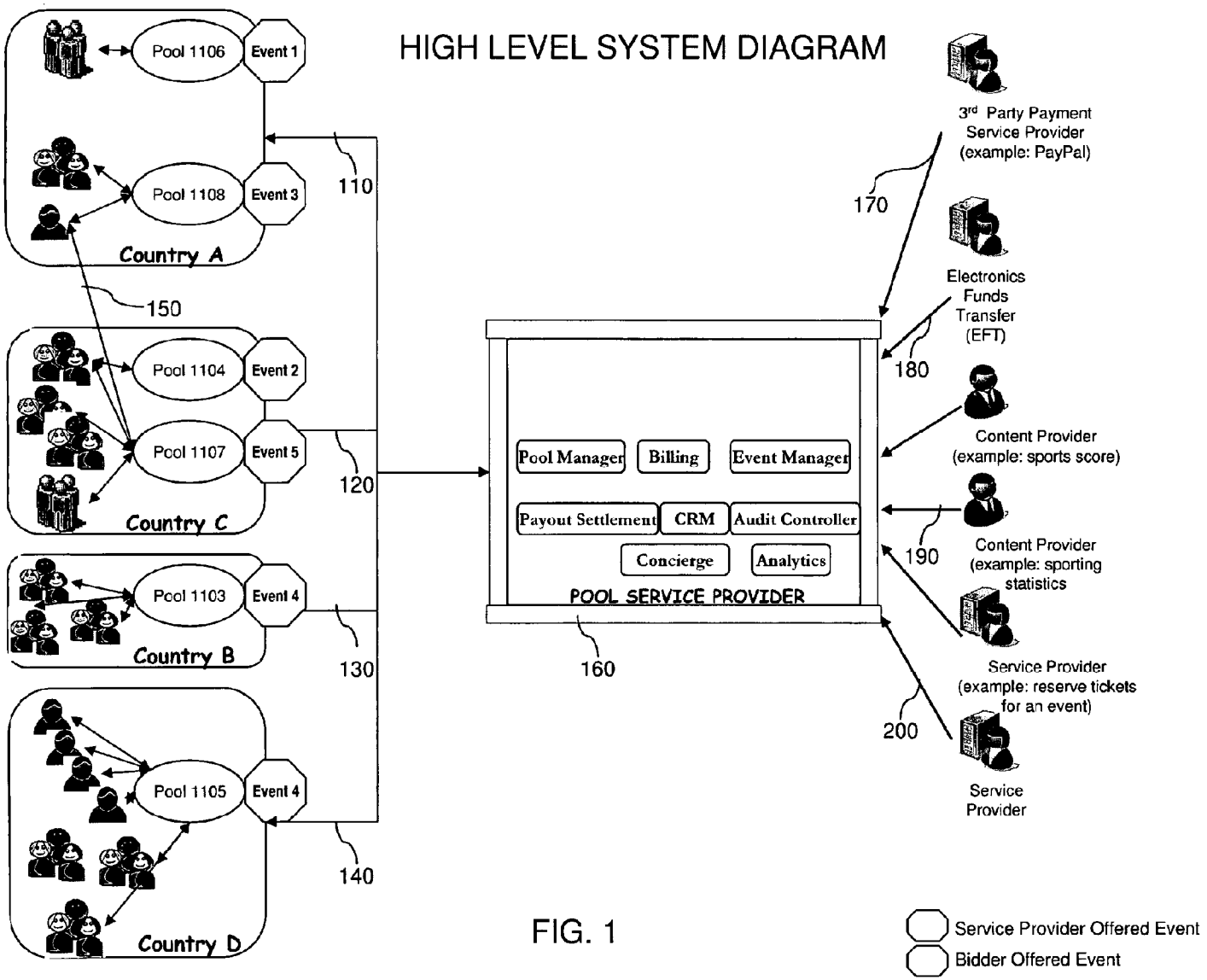
FIG. 1 illustrate, system for implementing various embodiments of the invention.

Aspects of the invention are disclosed in the following description and related drawings directed to specific embodiments of the invention. Alternate embodiments may be devised without departing from the scope of the invention. Additionally, well-known elements of the invention will not be described in detail or will be omitted so as not to obscure the relevant details of the invention.

The word "exemplary" is used herein to mean "serving as an example, instance, or illustration." Any embodiment described herein as "exemplary" is not necessarily to be construed as preferred or advantageous over other embodiments. Likewise, the term "embodiments of the invention" does not require that all embodiments of the invention include the discussed feature, advantage or mode of operation.

Further, many embodiments are described in terms of sequences of actions to be performed by, for example, elements of a computing device. It will be recognized that various actions described herein can be performed by program instructions being executed by one or more processors, or by a combination of both. Additionally, these sequence of actions described herein can be considered to be embodied entirely within any form of computer readable storage medium having stored therein a corresponding set of computer instructions that upon execution would cause an associated processor to perform the functionality described herein. Thus, the various aspects of the invention may be embodied in a number of different forms, all of which have been contemplated to be within the scope of the claimed subject matter. In addition, for each of the embodiments described herein, the corresponding form of any such embodiments may be described herein as, for example, "logic configured to" perform the described action.

Embodiments of the invention allow bidders to participate in pools setup either by themselves, friends, family or unknown hosts and communities. This method allows bidders to increase the potential size of their winning by participating in an open-ended pool which would have otherwise been limited to bidders only known to each other. This invention will also allow bidders to bet on pools set up for local, regional and global sporting, political, social, financial and other types of events which are either set up by the service provider or pool owners.

Bidders can view live pools, number of participants in a pool, names of other bidders who have listed the bidder as a buddy, wager required, total wager in the pool before placing their own wager. Pool owner at their discretion can prevent other interested bidders from participating in their own pool. First time bidders will be required to register with pool service provider using the logic described below for the partner relationship management (PRM) module 320.

The logic modules can receive input from each partner through the web interface which will be validated through web services from public domain as well as internally developed web services. For example, the following list of variables can be obtained for setting up a partner profile:

| Key | Element | Attribute | Length | Values | Mandatory |
|---|---|---|---|---|---|
| Y | Partner Type | AlphaNum | 1 | B - bidder/pool participant, C - content provider, S - non-financial service provider, P - payment service provider | Y |
| Y | Partner Identifier Number | Num | 16 | Should be unique except for partners who have more than 1 relationship with our entity, generated by system | Y |
| | Partner name | AlphaNum | 30 | | Y |
| | Address Line 1 | AlphaNum | 40 | | Y |
| | Address Line 2 | AlphaNum | 40 | | N |
| | City | AlphaNum | 25 | | Y |
| | Postal Code | AlphaNum | 10 | | Y |
| | State/Region | AlphaNum | 20 | | Y |
| | Country | Alpha | 3 | ISO ALPHA-3 code (http://unstats.un.org/unsd/methods/m49/m49alpha.htm) | Y |
| | Home Phone Number | Num | 15 | | Y |
| | Mobile Phone Number | Num | 15 | | N |
| | e-mail address | AlphaNum | 35 | | Y |
| | Creation Date | Date | 8 | YYYYMMDD, ISO 8601 | Y |
| | Creation Time | Time | 6 | HH:MM:SS, ISO 8601 | Y |
| | Last Update Date | Date | 8 | YYYYMMDD, ISO 8601 | Y |
| | Last Update Time | Time | 6 | HH:MM:SS, ISO 8601 | Y |

Financial information required for settling debits and credits to accounts will be based on set up of billing profile unless partner payment preference is a 3rd party-payment service provider such as PayPal. For example, the following list of variables can be obtained for setting up a partner profile:

| Key | Element | Attribute | Length | Values | Mandatory |
|---|---|---|---|---|---|
| Y | Partner Type | AlphaNum | 1 | Derived from Partner Relationship Table | Y |
| Y | Partner Identifier Number | Num | 16 | Derived from Partner Relationship Table | Y |
| | Partner name | AlphaNum | 30 | Derived from Partner Relationship Table | Y |
| | Home Phone Number | Num | 15 | Derived from Partner Relationship Table | Y |
| | Mobile Phone Number | Num | 15 | Derived from Partner Relationship Table | N |
| | e-mail address | AlphaNum | 35 | Derived from Partner Relationship Table | Y |
| | Billing Address Line 1 | AlphaNum | 40 | Required for only Partner Type "B" unless 3rd party payment service provider is associated. If same as primary address, allow copying details from primary table | Y |
| | Billing Address Line 2 | AlphaNum | 40 | Required for only Partner Type "B" unless 3rd party payment service provider is associated. If same as primary address, allow copying details from primary table | N |
| | Billing City | AlphaNum | 25 | Required for only Partner Type "B" unless 3rd party payment service provider is associated. If same as primary address, allow copying details from primary table | Y |
| | Billing Postal Code | AlphaNum | 10 | Required for only Partner Type "B" unless 3rd party payment service provider is associated. If same as primary address, allow copying details from primary table | Y |
| | Billing State/Region | AlphaNum | 20 | Required for only Partner Type "B" unless 3rd party payment service provider is associated. If same as primary address, allow copying details from primary table | Y |
| | Billing Country | Alpha | 3 | Required for only Partner Type "B" unless 3rd party payment service provider is associated. ISO ALPHA-3 code (http://unstats.un.org/unsd/methods/m49/m49 alpha.htm) | Y |
| | Payment Type | Alpha | | Required for only Partner Type "B" unless 3rd party payment service provider is associated. AMEX/Visa/MasterCard/PayPal | Y |
| | Credit Card Number | Num | | Required for only Partner Type "B" unless 3rd party payment service provider is associated. | Y |
| | Name on Credit Card | Alpha | | Required for only Partner Type "B"unless 3rd party payment service provider is associated. | Y |
| | Expiration Date | Date | | Required for only Partner Type "B" unless 3rd party payment service provider is associated. MMYY format | Y |
| | Security Code | Num | | Required for only Partner Type "B" unless 3rd party payment service provider is associated. | Y |
| | Bank Name | Alpha | | Used only if no credit card details provided | Y |

-continued

| Key | Element | Attribute | Length | Values | Mandatory |
|---|---|---|---|---|---|
| | Bank Account Number | Num | | Used only if no credit card details provided | Y |
| | IBAN | AlphaNum | | Used only if no credit card details provided, mutually exclusive of SWIFT code | Y |
| | SWIFT Code | | | Used only if no credit card details provided, mutually exclusive of IBAN code | Y |
| | 3rd Party Payment Service Provider | | | PayPal support for now | |
| | Creation Date | Date | 8 | YYYYMMDD, ISO 8601 | Y |
| | Creation Time | Time | 6 | HH:MM:SS, ISO 8601 | Y |
| | Last Update Date | Date | 8 | YYYYMMDD, ISO 8601 | Y |
| | Last Update Time | Time | 6 | HH:MM:SS, ISO 8601 | Y |

Once the details in the partner profile are validated, the partner is activated for conducting transactions through this system.

Referring to FIG. 1, a system level diagram is illustrated showing an exemplary architecture according to at least one embodiment of the invention. For example, bidders 110/140 known to each other can setup a pool for an event (Event 1) defined by them as well as allow placing wagers on event (Event 3) by bidders from the same country not known to them. Bidders 120 can place wager on events in multiple pools including those setup by the service provider (Event 5) with the same country or foreign countries too. Communities of bidders 130 within the same country can place their wager on pools for events setup by service provider.

Pool Service Provider 160 hosts additional logic to support $3^{rd}$ party payment service provider (PayPal) 170 allowing bidders to pay for their wagers on events associated with pools and to providers of premium services and content. Credit card or electronic funds transfer (EFT) processors 180 registered as partners will provide direct and indirect content and services to bidders. Content providers and service providers 190-200 can attract new clients through Pool Service Provider resulting in additional revenue from the content and service providers in the form of a referral fee.

Figure 2:
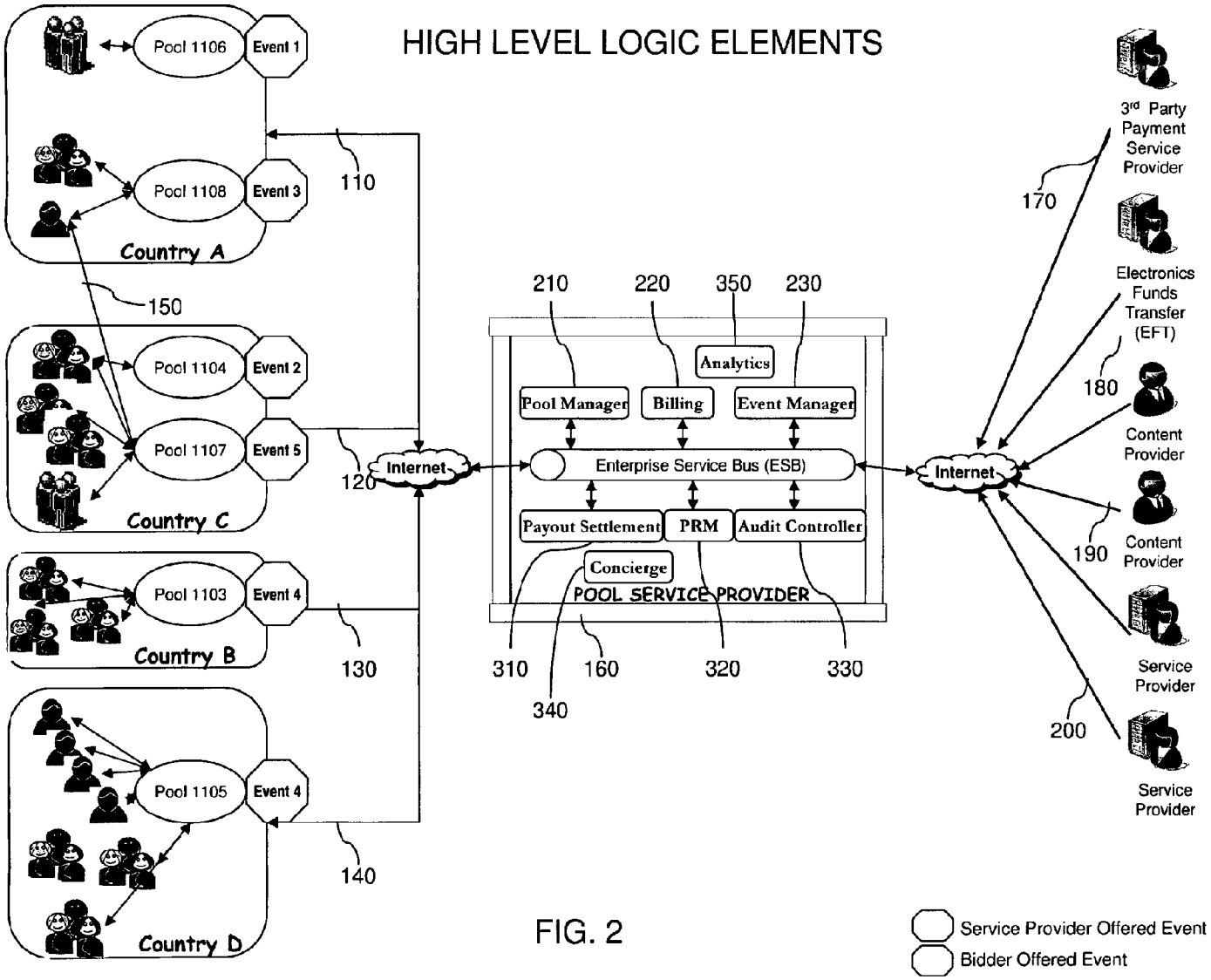
FIG. 2 illustrates logic elements in accordance with at east one embodiment of the invention.
Figure 3:
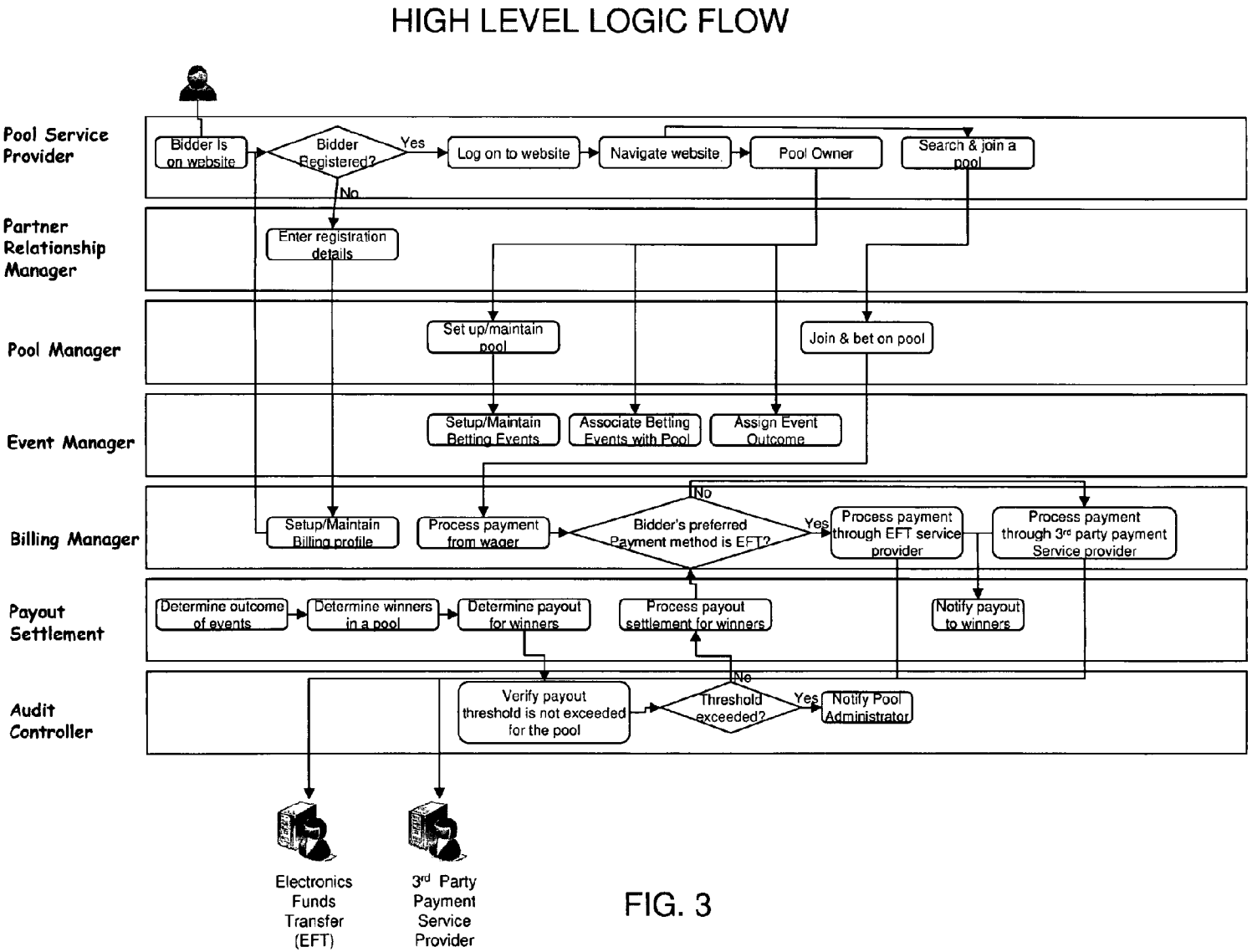
FIG. 3 is a flowchart illustrating methods in accordance with at least cine embodiment of the invention.

Referring to FIG. 2, a system for hosting and managing betting pools is illustrated. The system can include logic 210 to manage the life of the betting pool from inception to settlement based on methods and sub-methods of the Pool Manager. The Pool Manager will allow Host Bidder to setup betting pool associated with a pending event which is already setup by the Host Bidder or by Pool Service Provider. The Pool Manager also verifies bidder's eligibility to place a wager on the event related to the pool contingent upon bidder being accepted by the Host Bidder of the pool. The logic embedded in the Pool Manager will also verify bidder's payment for the wager is processed and credited to the pool account. Bidder can also place wager in multiples of base wager of up to a maximum of three-times the base wager. The base wager amount should be a minimum of USD 15 and cannot exceed 1,000 in base wager currency. The logic of the Pool Manager also allows Pool Service Provider or Host Bidder to associate a pre-defined event with the pool. Through the Pool Manager, an event established by a Host Bidder can be made accessible to other registered bidders not known to the Host Bidder. Logic in Pool Manager will also perform high-level data gathering required to support the logic and other logic modules based on the Pool Master schema shown below:

| Key | Element | Attribute | Length | Values | Mandatory |
|---|---|---|---|---|---|
| Y | Pool ID | Num | 20 | | Y |
| Y | Pool Name | AlphaNum | 60 | | Y |
| Y | Open Date | Date | 8 | | Y |
| | Expiration Date | Date | 8 | | Y |
| | Expiration Time | Time | 6 | | Y |
| | Settlement Date | Date | 9 | | Y |
| | Owner Identifier Number | Num | 16 | | Y |
| | Owner Name | AlphaNum | 30 | Partner (Bidder name)/Pool Service Provider Name, must match ID and name from PRM Table | Y |
| | Finite Outcome Expected | Alpha | 1 | Y, N | Y |
| | Open Ended Pool | Alpha | 1 | Y | |
| | Base Wager | Num | 9 | | |
| | Base Wager Currency | Alpha | 3 | | |
| | Creation Date | Date | 8 | | Y |
| | Creation Time | Time | 6 | | Y |
| | Last Update Date | Date | 8 | | Y |

-continued

| Key | Element | Attribute | Length | Values | Mandatory |
|---|---|---|---|---|---|
| | Last Update Time | Time | 6 | | Y |

Logic in Pool Manager 210 will also perform high-level data gathering required to support the logic and other logic modules based on the Pool Master Definition schema shown below:

| Key | Element | Attribute | Length | Values | Mandatory |
|---|---|---|---|---|---|
| Y | Pool ID | Num | 20 | | Y |
| Y | Pool Name | AlphaNum | 60 | | Y |
| Y | Date | Date | 8 | | Y |
| Y | Time | Time | 6 | | Y |
| Y | Transaction Type | AlphaNum | 3 | 001 - New Wager, 002 - Wager Payment From Bidder Processed, 003 - Settlement Payment To Winning Bidders Processed, 004 - Adjustment Debit, 005 - Adjustment Credit, 999 - Pool closed prematurely | Y |
| Y | Partner Identifier Number | Num | 16 | Derived from Partner Relationship Table | Y |
| | Partner IP Address | Hex | 32 | | |
| Y | Sequence Number | Num | 3 | Auto-increment starting from 001 through 999 | Y |
| | Transaction Amount in local currency | Num | 9 | | Y |
| | Transaction Currency code | Alpha | 3 | Currency codes - ISO 4217, http://www.iso.org/iso/en/prods-services/popstds/currencycodeslist.html | Y |

The Event Manager 230 includes the logic for allowing Pool Service Provider or Host Bidder to establish an event based on no pre-defined outcome or pre-defined outcome. These events could be setup using feed from external sources or Host Bidder defined events either with or without projected probabilities for each possible outcome of the event. The Event Manager also includes the logic for assigning outcome of an event defined by Host Bidder. The logic module supports required data gathering based on the Pool Event Master definition schema shown below:

| Key | Element | Attribute | Length | Values | Mandatory |
|---|---|---|---|---|---|
| Y | Pool ID | Num | 20 | | Y |
| Y | Pool Name | AlphaNum | 60 | | Y |
| Y | Set-up Date | Date | 8 | | Y |
| Y | Set-up Time | Time | 6 | | Y |
| Y | Sequence Number | Num | 3 | Auto-increment starting from 001 through 999 | Y |
| | Sub-sequence Number | Num | 3 | Auto-increment starting from 001 through 999 | Y |
| | Outcome Name | AlphaNum | 60 | | Y |
| | Outcome Type | AlphaNum | 1 | Boolean - "B", Numeric - "N", Ranking - "R" | Y |
| | Projected Outcome Value | Num | 10 | For Boolean store either 0 for FALSE or 1 for TRUE. For numerical outcome, absolute numerical value must be assigned. For ranking, assign ascending rank beginning with 1 | Y |
| | Actual Outcome Value | Num | 10 | For Boolean store either 0 for FALSE or 1 for TRUE. For numerical outcome, absolute numerical value must be assigned. For ranking, assign ascending rank beginning with 1 | Y |

The Billing module 220 has the logic to process payments of bidders placing wagers on pools, settlement payment to bidders in the pool as determined, payments from service providers for referring bidders to service providers' services and content. The Billing module's logic also performs the function of data to support the logic of the billing module and other modules.

The Billing module interfaces with third-party payment service providers 170 (example: PayPal) and other 180 local EFT service providers. The Billing module also sends payment confirmation status to the Pool Manager for confirming acceptance of bidders' wager on the pool. If the Billing Manager is unable to verify payment through third-party payment service provider, then the logic of the Pool Manager will reject bidder's wager on the pool. Interaction between all logic modules is implemented using standard service oriented architecture (SOA) based on enterprise service bus (ESB).

The Payout Settlement module 310 has the logic to determine which bidders qualify for payout and how much based on the algorithm below:

```
IF <Pool Master.Finite Outcome Expected> = "Y"
    VAR <SUMMARY WAGER> = 0;
    VAR <WINNING OUTCOME SEQUENCE> = 0;
    INITIALIZE ARRAY <Pool Transactions Preliminary Settlement>;
    LOOP TABLE <Pool Event Master> UNTIL <Pool Master.Pool ID> = <Pool
    Event Master.Pool ID>
        IF <Pool Event Master.Projected Outcome Value> = <Pool Event
        Master.Actual Outcome Value>
            <WINNING OUTCOME SEQUENCE> = <Pool Event
            Master.Sequence Number>;
        ELSE
            IF <WINNING OUTCOME SEQUENCE> != 0
                <WINNING OUTCOME SEQUENCE> = 0;
            ENDIF
        ENDIF
    ENDLOOP
    LOOP TABLE <Pool Transactions> UNTIL <Pool Transactions.Pool ID> =
    <Pool Master.Pool ID> AND <Pool Transactions.Transaction Type> = "002"
        VAR <SUMMARY WAGER> = <Pool Transactions.Transaction
        Amount in local currency> + <SUMMARY WAGER>;
        IF <Pool Transactions.Sequence Number> = <WINNING OUTCOME
        SEQUENCE>
            WRITE TO ARRAY <Pool Transactions Preliminary
            Settlement>
            Pool ID, Pool Name, Partner Identifier Number, Sequence
            Number, Transaction Amount in Local Currency, Transaction
            Currency Code, Payout in Local Currency = 0 /* write partial
            record so at the end actual settlement amount can be calculated */
            ENDIF
    END LOOP TABLE
/* If payout settlement needs to be done, write-out payout settlement transactions for
further processing*/
    IF ARRAY <Pool Transactions Preliminary Settlement> is NOT EMPTY
        VAR <TOTAL PAYOUT> = 0.75 * <SUMMARY WAGER>;
        LOOP ARRAY <Pool Transactions Preliminary Settlement> TILL
        NULL
            <Payout Amount> = (<Pool Transactions Preliminary
            Settlement.Transaction Amount in local currency[n]>/
            <SUMMARY WAGER>) * <TOTAL PAYOUT>;
            WRITE to TABLE <POOL TRANSACTIONS>
                Pool ID, Pool Name, Date, Time, Transaction Type =
                "003", Partner Identifier Number, Sequence Number,
                Transaction Amount in Local Currency = <Payout
                Amount>, Transaction Currency Code /* write settlement
                record */
            n++ ;
        END LOOP ARRAY
ELSE /* Process Payout to bidder with bet closest to the actual outcome
*/
    VAR <SUMMARY WAGER> = 0;
    VAR <Payout Amount> = 0;
    INITIALIZE ARRAY <Pool Transactions Preliminary Settlement>;
    INITIALIZE ARRAY <Nearest Bidder>;
    LOOP TABLE <Pool Transactions> UNTIL <Pool Transactions.Pool
    ID> = <Pool Master.Pool ID> and <Pool Transactions.Transaction
    Type> = "002"
        LOOP TABLE <Pool Event Master> UNTIL <Pool
        Transactions.Pool ID> = <Pool Event Master.Pool ID> AND
        <Pool Transactions.Sequence Number> = <Pool Event
        Master.Sequence Number>
        <Proximity Rate> = <Pool Event Master.Projected Outcome
        Value> / <Pool Event Master.Actual Outcome Value>
            WRITE TO ARRAY <Nearest Bidder>
            Pool ID, Pool Name, Partner Identifier Number, Sequence
            Number, Proximity Rate/* write partial record so at the
            end actual settlement amount can be calculated */
        ENDLOOP
```

-continued

```
        <SUMMARY WAGER> = <Pool Transactions.Transaction
        Amount in local currency> + <SUMMARY WAGER>;
    ENDLOOP
        SORT ARRAY <Nearest Bidder> DESCENDING <Proximity
        Rate>
        <Payout Amount> = <SUMMARY WAGER> * 0.70
        WRITE to TABLE <POOL TRANSACTIONS>
            Pool ID[1], Pool Name[1], Date, Time, Transaction Type =
            "003", Partner Identifier Number[1], Sequence
            Number[1], Transaction Amount in Local Currency =
            <Payout Amount>, Transaction Currency Code /* write
            settlement record */
ENDIF
/* Complete Payout through payment service provider */
INIT AUDIT_CHECK PARM (Pool ID) /* Verify total payout does not exceed the
75% threshold of total wagered amount in the pool /*
LOOP TABLE <Pool Transactions> UNTIL <Pool Transactions.Transaction Type> =
"003" AND <Pool Transactions.Payment Date> = NULL
    INIT EXTRNAL_SECURED_PAYMENT_SERVICE /* Paypal or EFT
    Processor*/
    IF ACKNOWLEDGMENT is "OK"
        UPDATE TABLE <Pool Transactions>
            <Pool Tranactions.Payment Date> = SYSTEM DATE, <Pool
            Transactions.Payment Time> = SYSTEM TIME;
        INIT WINNER_NOTIFICATION /* Notify Winners via preferred email
        address */
    ENDIF
ENDLOOP
```

Logic in module 330 Audit Controller maintains a log of all interactions between partners and the Pool Service Provider. In an event of a dispute arising between partners and the Pool Service Provider or between partners, the Audit Controller can provide activity insight based on date, time, financial transactions, partner identification and authentication. The logic in module 330 also provides control point for both inbound (accounts receivable) and outbound payments (accounts payable). For outbound payments, the logic in module 330 checks that total payment to pool participants does not exceed predetermined thresholds (75% of total wagered amount for the pool in case the outcome of the event matches exactly with wager's predicted outcome for the event associated with the pool or else 70% of total wagered amount for the pool for wager with nearest outcome to the actual outcome of the event).

Logic in module 340 Concierge allows partners to buy and sell products or services from each other including third-party service and content providers, buy gift vouchers which can be redeemed by other members with the pool service provider.

Logic in module 350 Analytics aggregates, sorts and presents data related to open events such as number of wagers and total wager per event; data related to closed events such as number of wagers, total wager, number of winners and total payout per event, number of wagers and total wager per pool; number of winners and total payout per pool, other daily and monthly statistics.

Those of ordinary skill in the art understand that data, information and signals may be represented in a number of different ways, using various technologies and techniques. The logical blocks in the flow charts, circuits, and components described in connection with the various embodiments may be implemented as hardware, software, firmware, or some combination thereof. Those of ordinary skill in the art would know to implement the described embodiments using various design options, depending upon the particular constraints and considerations of the situation. Such design choices are not a departure from the scope of the present invention.

The various logical blocks depicted in the flow charts, circuits, and components may be implemented using a personal computer, a microprocessor, a controller, a digital signal processor (DSP), an application specific integrated circuit (ASIC), using discrete or integrated circuitry, or a combination of these. A general purpose processor may be a microprocessor, but in the alternative, the processor may be any conventional processor, microcontroller, or state machine.

The method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a DVD/CD, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

The various steps and activities in the embodiments described herein may be performed in the exemplary order illustrated in the figures, or another order, depending upon the particularities of the implementation. Various other activities and steps may be performed in a sequence other than that illustrated in the figures.

The disclosure of the various embodiments is provided so as to enable those of ordinary skill in the art to make and use the present invention. Design choices and modifications to the various embodiments will occur to practitioners of ordinary skill in the art without departing from the spirit or scope of the invention. The present invention is not intended to be limited only to those specific versions which are discussed herein for the sake of illustration, but is to be accorded the widest scope for the features and aspects of the invention enabled herein and recited in the appended claims.

What is claimed is:

1. A computer implemented method for allowing a betting pool leader to host a betting pool, comprising:

establishing and managing the betting pool with a processor and associated computer storage medium of the betting pool leader;

registering a group of bidders who are known and/or unknown to the pool leader hosting the betting pool for access by the processor;

programming the processor and associated computer storage medium to allow the betting pool leader to set up an event to subsequently associate with the betting pool by setting up an event with finite outcome, unknown outcome and/or multiple possible outcomes;

enabling the pool leader to establish whether the event is open to the group of bidders who are known to the betting pool leader, or whether the event is open to the group of bidders that are known and/or unknown to the betting pool leader; and accepting wagers from the group of bidders having access to the event based on whether the event is open to only the group of bidders that are known to the pool leader or to the group of bidders that are known and/or unknown to the betting pool leader.

2. The computer implemented method of claim 1, comprising:

associating the betting pool with an event which was set up by a betting pool service provider.

3. The computer implemented method of claim 1, comprising:

determining a pool bidder whose prediction of an outcome for an event expected to have a finite outcome matches an actual outcome.

4. The computer implemented method of claim 3, comprising:

calculating a payout to bidders whose predicted outcome of the event associated with their bid matches the actual outcome of the event.

5. The computer implemented method of claim 1, comprising:

determining a pool bidder whose prediction of an outcome for an event expected to have a non-finite outcome is closest to an actual outcome; and calculating a payout to bidders whose predicted outcome of the event associated with their bid is the closest to the actual outcome of the event.

6. The computer implemented method of claim 1, wherein the acceptance of unknown bidders to place wagers on the event is contingent upon the unknown bidders being accepted by the betting pool leader.

7. The computer implemented method of claim 1, comprising:

allowing unknown bidders to access an event that is open to the group of bidders who are known to the betting pool leader based on a partner relationship with known bidders, and wherein the unknown bidders have access to the event, only if the unknown bidder is known by at least one of the group of bidders that are known to the betting pool leader.

8. The computer implemented method of claim 1, comprising:

comparing actual outcomes of events with predicted outcomes of events as predicted by betting pool participants;

calculating a payout to participants in the betting pool proportionate to their wager; and processing the payout.

9. The computer implemented method of claim 1, comprising:

comparing actual outcomes of events with predicted outcomes of events as predicted by betting pool participants for non-finite outcomes to determine at least one participant with a predicted outcome nearest to the actual outcome of the event;

calculating a payout to the at least one participant in the betting pool; and processing the payout.

10. A system for hosting a betting pool, comprising:

logic configured to set up open-ended and/or closed-ended betting pools, the open-ended betting pool being a group of bidders that are known and/or unknown to a betting pool leader; and the closed-ended betting pool being a group of bidders that are known to the betting pool leader;

logic configured to set up and maintain events which can be associated with the betting pools;

logic configured to enable the pool leader to establish whether the event is open to the group of bidders who are known to the betting pool leader, or whether the event is open to the group of bidders that are known and/or unknown to the betting pool leader;

logic configured to set up and maintain more than one possible outcome for the events;

logic configured to set up partner relationship profiles through a partner relationship module (PRM) of a web based interface; and logic configured to retrieve external events for use by the betting pools logic.

11. The system of claim 10, comprising:

logic configured to compare actual outcomes of the events with predicted outcomes of events as predicted by betting pool participants;

logic configured to calculate payouts to betting pool participants of the betting pool in amounts proportionate to their wager;

logic configured to process the payouts; and logic configured for non-finite outcomes to determine a betting pool participant with a predicted outcome nearest to an actual outcome of an event.

12. The system of claim 10, comprising:

logic configured to maintain a log of all interactions between partners and a pool service provider, and wherein in an event of a dispute arising between the partners and the pool service provider or between partners, an audit controller provides activity insight based on date, time, financial transactions, partner identification and authentication.

13. The system of claim 10, comprising:

logic configured to allow partners to buy and sell products or services from each other including third-party service and content providers, which can be redeemed by other members with the pool service provider.

14. The system of claim 10, comprising:

logic configured to:

aggregate, sort and present data related to open events including number of wagers and total wager per event;

aggregate, sort and present data related to closed events such as number of wagers, total wager, number of winners and total payout per event, number of wagers and total wager per pool; and aggregate, sort and present data related to number of winners and total payout per pool, and daily and/or monthly statistics.

15. A non-transitory computer readable media embodying a computer implemented method for allowing a betting pool leader to host a betting pool, comprising:

establishing and managing the betting pool with a processor and associated computer storage medium of the betting pool leader;

registering bidders who are known and/or unknown to the pool leader hosting the betting pool for access by the processor;

programming the processor and associated computer storage medium to allow the betting pool leader to set up an event to subsequently associate with the betting pool by setting up an event with finite outcome, unknown outcome and/or multiple possible outcomes;

enabling the pool leader to establish whether the event is open to the group of bidders who are known to the betting pool leader, or whether the event is open to the group of bidders that are known and/or unknown to the betting pool leader; and accepting wagers from the group of bidders having access to the event based on whether the event is open to only the group of bidders that are known to the pool leader or to the group of bidders that are known and/or unknown to the betting pool leader.

16. The non-transitory computer readable media of claim 15, wherein the event is social, political, sports, weather, financial and/or economic, and/or the event is known publicly or is known only to the bidders of the betting pool.

17. The non-transitory computer readable media of claim 15, wherein the method comprises:

comparing actual outcomes of events with predicted outcomes of events as predicted by betting pool participants;

calculating a payout to participants in the betting pool proportionate to their wager;

processing the payout; and determining a participant with a predicted outcome nearest to the actual outcome of the event.

18. The non-transitory computer readable media of claim 15, wherein the method comprises:

comparing actual outcomes of events with predicted outcomes of events as predicted by betting pool participants for non-finite outcomes to determine at least one participant with a predicted outcome nearest to the actual outcome of the event;

calculating a payout to the at least one participant in the betting pool; and processing the payout.

* * * * *